US006026851A

United States Patent [19]

Rosenberg

[11] Patent Number: 6,026,851

[45] Date of Patent: Feb. 22, 2000

[54] SNAP-ACTION VALVE

[76] Inventor: Peretz Rosenberg, Moshav Beit Shearim, 30046 Doar Na Haamakim, Israel

[21] Appl. No.: 09/119,401

[22] Filed: Jul. 21, 1998

[30] Foreign Application Priority Data

Jul. 23, 1997 [IL] Israel ..... 121380

[51] Int. Cl.[7] ..... E03B 7/07; B05B 1/08

[52] U.S. Cl. ..... 137/508; 137/624.14

[58] Field of Search ..... 137/508, 624.14; 138/30

[56] References Cited

U.S. PATENT DOCUMENTS

| | | | |
|---|---|---|---|
| 2,416,205 | 2/1947 | Nolan | 137/508 |
| 3,258,029 | 6/1966 | Parrino | 137/508 |
| 3,419,251 | 12/1968 | Eckert | 137/508 X |
| 3,450,155 | 6/1969 | Froehner et al. | 137/508 |
| 3,826,280 | 7/1974 | Perham | 137/624.14 |
| 4,137,941 | 2/1979 | Gonin | 137/508 |
| 4,301,967 | 11/1981 | Hunter | 137/624.14 X |
| 4,781,217 | 11/1988 | Rosenberg | 137/624.14 |
| 4,922,955 | 5/1990 | Uri | 137/508 X |
| 5,201,342 | 4/1993 | Rosenberg | 137/624.14 |
| 5,314,116 | 5/1994 | Krauth et al. | 239/99 |
| 5,950,676 | 9/1999 | Rosenberg | 137/624.14 |

*Primary Examiner*—John Rivell
*Attorney, Agent, or Firm*—Benjamin J. Barish

[57] ABSTRACT

A snap-action valve includes a housing defining a fluid chamber and a deformable membrane mounted within the chamber in alignment with an outlet opening in a wall of the housing. The membrane has an inner face exposed to the pressure within the chamber, and an outer face exposed to the ambient pressure via the outlet opening. The wall of the housing formed with the outlet opening is displaceable from the wall of the: housing formed with the inlet opening such that an increase in pressure in the chamber causes the membrane to deform to maintain the outlet opening closed until the displacement of the two walls exceeds the deformability of the membrane, whereupon the membrane opens the outlet opening with a snap-action to discharge a quantity of the fluid from the chamber and then recloses with a snap-action upon release of the pressure resulting from such discharge.

20 Claims, 3 Drawing Sheets

SNAP-ACTION VALVE

FIELD AND BACKGROUND OF THE INVENTION

The present invention relates to valves for controlling fluid flow, and particularly to snap-action valves. The invention is especially useful in water irrigation devices and is therefore described below with respect to this application, but it will be appreciated that the invention could be used in many other applications of snap-action valves.

An important characteristic of a snap-action valve is that its movements from its closed and open positions be quick and positive, that in its closed position it effectively seal the valve opening, and that in its open position it introduce a minimum pressure drop of the fluid flow through the valve opening. A large number of different types of snap-action valves have been designed for various application, but efforts are continuously made to increase the efficiency of such snap-action valves, to simplify their structure, and to reduce their costs.

OBJECTS AND BRIEF SUMMARY OF THE INVENTION

An object of the present invention is to provide a snap-action valve having advantages in the above respects.

According to a broad aspect of the present invention, there is provided a snap-action valve, comprising: a housing defining a fluid chamber, the housing including a first wall having an inlet opening for conducting a fluid into the chamber, and a second wall having an outlet opening for conducting fluid out of the chamber; and a deformable membrane mounted within the chamber in alignment with the outlet opening. The deformable membrane has an inner face exposed to the pressure within the chamber, and an outer face exposed to a lower pressure via the outlet opening, such that the differential pressure on the opposite faces of the membrane normally presses the membrane against the second wall to close the outlet opening. The second wall of the housing is displaceable away from the first wall of the housing to expand the chamber upon an increase in pressure within the chamber such that the differential pressure on the opposite faces of the membrane causes the membrane to deform and to maintain the outlet opening closed until the displacement of the second wall exceeds the deformability of the membrane, whereupon the membrane opens the outlet opening with a snap-action to discharge a quantity of the fluid from the chamber and then recloses with a snap-action upon release of the pressure resulting from such discharge.

According to further features in the described preferred embodiment, the outer face of the deformable membrane is exposed to the atmosphere via the outlet opening. Also, the deformable membrane is mounted within the chamber by a stem passing through the inlet opening and received within a sleeve integrally formed with the first wall in alignment with the inlet opening. More particularly, in the described preferred embodiment, the central portion of the membrane is secured to the stem, and the outer periphery of the membrane is deformable by the pressure within the chamber to follow the displacement of the second wall until such displacement exceeds the deformability of the membrane causing the membrane to open the outlet opening with a snap-action.

According to further features in the described preferred embodiment, the sleeve, stem and deformable membrane define a reduced-flow passageway from a source of pressurized fluid to the chamber, which passageway permit a lower rate of fluid flow via the inlet opening into the chamber than that permitted by the outlet opening from the chamber.

As will be described more particularly below, the foregoing features enable snap-action valves to be constructed from simple parts which can be produced and assembled in volume and at low cost, and which provide an efficient snap-action movement to both the fully-open and fully-closed positions of the valve.

According further features in the described preferred embodiment, the first and second walls of the housing constitute an expansible bellows defining the chamber. More particularly, the first and second walls are circular plates joined together at their outer peripheries and formed with annular recesses which permit the central portions of the plates to flex outwardly when the chamber is pressurized. The inlet and outlet openings are formed centrally of their respective circular plates.

Such a bellows construction used in a pulsator device is described in my prior U.S. patent application Ser. No. 08/746,510 filed Nov. 12, 1996. Thus, when the snap-action valve housing is of the bellows construction described in that patent application, it not only enables the snap-action valve to be used as a pulsator device, but also permits the use of the same basic parts in the bellows described in that patent application, thereby further reducing the production and initial tooling costs.

While the snap-action valve of the present invention is particularly useful in the bellows-type pulsator device as described in the above-cited patent application, it will be appreciated that it could be used in many other pulsator devices, such as those described in the prior patents referred to in that patent application, as well as in many other applications for snap-action valves.

Further features and advantages of the invention will be apparent from the description below.

BRIEF DESCRIPTION OF THE DRAWINGS

The invention as herein described, by way of example only, with reference to the accompanying drawings, wherein:

FIG. 3 illustrates the valve in its condition immediately after snap-opening;

DESCRIPTION OF A PREFERRED EMBODIMENT

Figure 1:
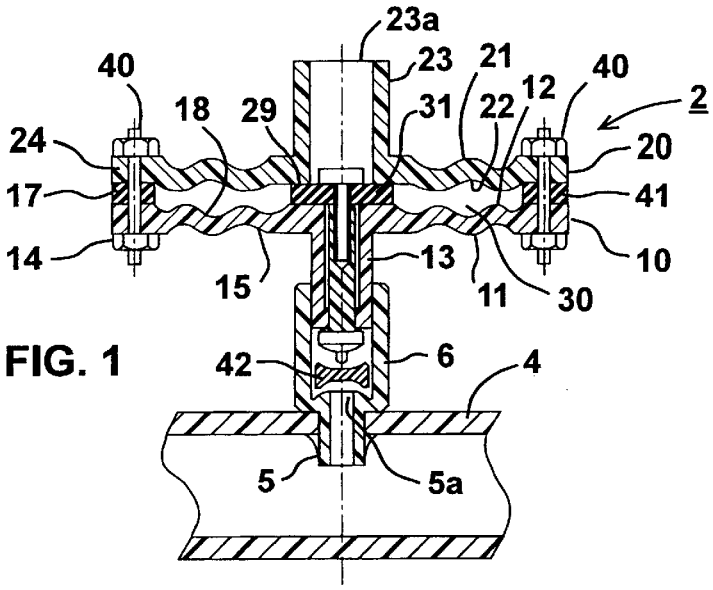
FIG. 1 is a longitudinal sectional view illustrating one form of snap-action valve constructed in accordance with the present invention, the valve being shown in its normally closed position.

The snap-action valve illustrated in FIG. 1, generally designated 2, is connectable to a water supply pipe 4 by a tap 5 through the wall of the pipe. Tap 5 has a connector 6 for receiving the valve. Valve 2 thus controls the supply of the water from pipe 4 to an irrigation device, such as a water sprinkler 7 shown in FIG. 8 connected to the outlet of the valve.

The housing ofsnap-action valve 2 is generally of the bellows construction described in my above-cited patent application Ser. No. 115969. It includes two circular end plates or discs 10, 20, which are attached together and sealed around their otter peripheries such that they constitute a housing defining a fluid chamber 30. Thus, end plate 10 includes an outer face 11, an inner face 12, and a central connector sleeve 13 defining an inlet opening 13*a* (FIG. 4) for conducting the water into chamber 30; whereas circular end plate 20 includes an outer face 21, an inner face 22, and a central connector sleeve 23 defining an the outlet opening 23*a* for discharging the water from chamber 30.

The outer face 11 of plate 10 is formed with a flat outer margin 14 and a plurality of concentric recesses 15 decreasing in diameter inwardly from margin 14 towards the central sleeve 13. The inner face 12 of end plate 10 is similarly formed with a flat outer margin 17 and with concentric circular recesses 18, which are aligned with the spaces between the concentric circular recesses 15 formed on the outer face 11.

Figure 4:
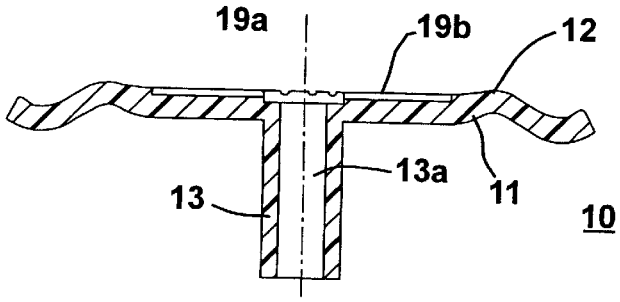
FIG. 4 is enlarged sectional view illustrating the inlet housing wall in the valve of FIGS. 1–3.
Figure 5:
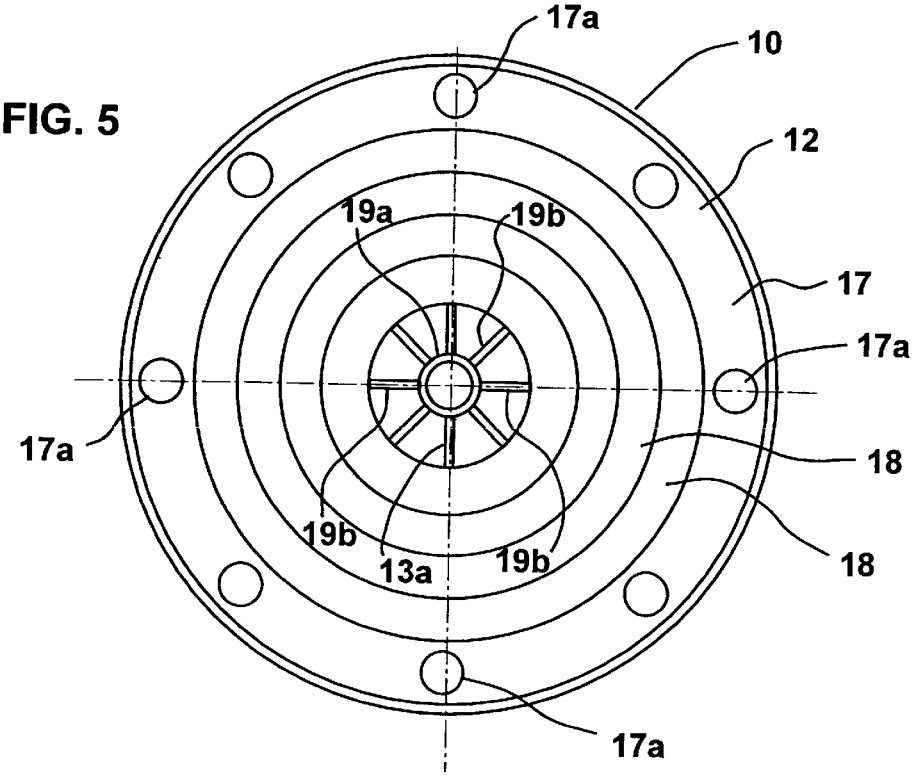
FIG. 5 is a top plan view illustrating the inner surface of the inner housing wall of FIG. 4.

The inner face 12 of end plate 10 is more particularly illustrated in FIGS. 4 and 5. Thus, its flat outer margin 17 is formed with a plurality of openings 17*a* for receiving the fasteners fastening it to plate 20, as will be described more particularly below. It further includes a central circular recess 19*a* around the inlet opening 13*a* defined by the connector sleeve 13, and a plurality of radially-extending recesses 19*b* radiating outwardly from the circular recess 19*a*.

End plate 20 is of similar construction. It includes a flat peripheral margin 24 and a plurality of concetric circular recesses 25, 28 on its inner and outer faces, respectively. In end plate 20, however, the central region 29 circumscribing outlet opening 23*a* of the outlet sleeve 23 is flat and is not formed with recesses corresponding to circular recesses 19*a* and radial recesses 19*b* in end plate 10.

It will thus be seen that end plate 20, constitutes a wall formed with the outlet opening 23*a*, is displaceable away from end plate 10, constituting a wall formed with inlet opening 13*a*, upon an increase in the pressure of the water within chamber 30. This will be more particularly described below in connection with the description of the overall operation of the illustrated snap-action valve.

Figure 6:
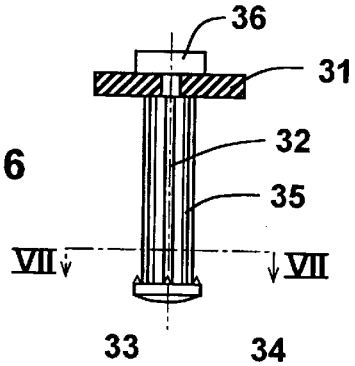
FIG. 6 is a side elevational view illustrating the stem and deformable membrane in the valve of FIGS. 1–3.
Figure 7:
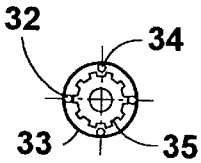
FIG. 7 is a sectional view along line VII—VII of FIG. 6.

The flat inner surface 29 of end plate 20 serves as a valve seat in cooperation with a deformable membrane 31 located within chamber 30 for controlling the flow of the water from that chamber via the outlet opening 23*a*. As shown particularly in FIG. 6, deformable membrane 31 is carried at the inner end of a stem 32 passing through the inlet opening 13*a*. Stem 32 is formed with enlarged head 33 having a plurality of spaced projections 34 on its inner surface engageable with the end of connector sleeve 13 so as to provide a flow passageway from socket 6 into the space between stem 32 and connector sleeve 13. Stem 32 is further formed with a plurality of axially-extending recesses 35 to conduct the water to the circular recess 19*a* on the inner face of end plate 10, and via the radial recesses 19*b* underlying the inner face of deformable membrane 31 into chamber 30.

Deformable membrane 31 is secured to the inner end of stem 32 by a fastener 36 passing through the center of the membrane. Thus, the center of membrane 31 is fixed to stem 32, but the outer periphery of the membrane is free to deform according to the differential pressure applied to the opposite faces of the membrane, as will be described more particularly below.

The two end plates 10, 20 are secured together by plurality of fasteners 40 passing through the flat outer peripheries 14, 24 of the two plates. A sealing ring 41 is interposed between the two plates to seal the chamber 30 defined by them. Although the two end plates 10, 20 are each made of substantially rigid plastic material, the concentric-recesses formed in their inner and outer faces permit their center regions to be displaced outwardly, and thereby to expand chamber 30 as the pressure within the chamber increases.

The axial recesses 35 in stem 32, and the recesses 19*a*, 19*b* in the inner face of end plate 10 covered by deformable membrane 31, define a reduced-flow passageway from the water supply pipe 4 into chamber 30 permitting a relatively low rate of water flow via the inlet opening 13*a* into the chamber. This low inflow rate is substantially lower than the outflow rate permitted through the outlet opening 23*a* when deformable membrane opens the outlet opening, as will be described more particularly below.

Preferably, a flow-reducer device or flow-regulating device, is also provided between the water supply pipe 4 and the inlet into chamber 30. In FIG. 1, this is illustrated by the provision of a floating disc 42 which freely oscillates with respect to the outlet opening 5*a* in the tap 5, as described for example in my prior U.S. patent application Ser. No. 08/746, 510.

The operation of the illustrated snap-action valve will now be described particularly with respect to FIGS. 1–3 which illustrate three stages in its operation.

FIG. 1 illustrates the initial condition of the valve, wherein it will be seen that membrane 31 is firmly seated against the flat central region 29 of plate 20 around the outlet opening 23*a*, thereby blocking the flow through the outlet opening.

The pressurized water from the water supply pipe 4 flows at a slow rate into chamber 30, via the flow-reducer 42, the axial recesses 32, the circular recesses 19*a* and the radial recesses 19*b*, thereby slowly pressurizing chamber 30. Since the outer face of membrane 31 is vented to the atmosphere via outlet opening 23*a*, the build-up of pressure within chamber 30 firmly presses the outer periphery of the membrane against the inner surface 29 of plate 20 thereby maintaining the valve in a closed condition.

Figure 2:
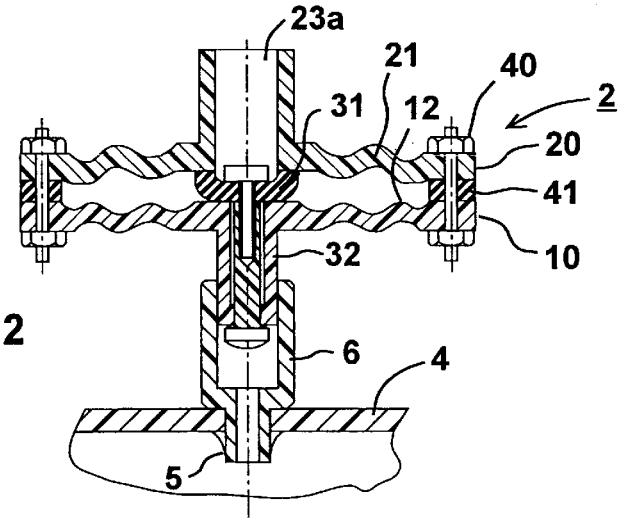
FIGS. 2 and 3 are corresponding views as FIG. 1, but FIG. 2 illustrates the valve in its condition just before snap-opening.
Figure 3:
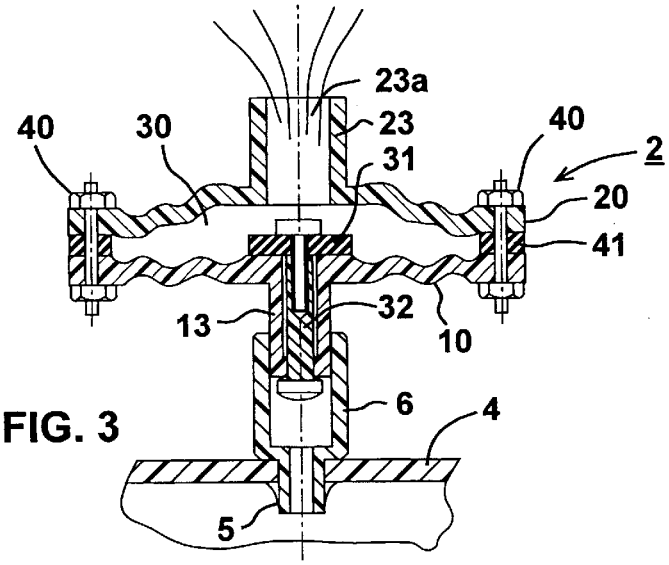

As the pressure within chamber 30 builds-up, the central region of plate 20 is displaced outwardly as shown in FIG. 2. However, since the central region in the outer face of diaphragm 31 is exposed to the atmosphere via outlet opening 23*a*, the outer periphery of the diaphragm will deform with the displacement of plate 20, thereby firmly maintaining the outlet 23*a* in its closed condition. This continues until the displacement of plate 20 exceeds the deformability of the membrane 31, whereupon the outer periphery of the membrane separates from the inner surface of plate 20 to open the outlet opening 23*a*. This produces a rapid discharge of a quantity of the water from chamber 30, thereby releasing the pressure within the chamber. As soon as this occurs the end plate 20 quickly returns to its normal unstressed condition in engagement with the periphery of the outer surface of membrane 31, as shown in FIG. 1, to reclose the valve.

It will thus be seen that the outlet opening 23*a* is both opened with a snap-action, and closed with a snap-action, such that in its closed condition it firmly seals the outlet opening against any leakage, and in its open condition it imposes a low resistance to the discharge of the water from chamber 30.

Figure 8:
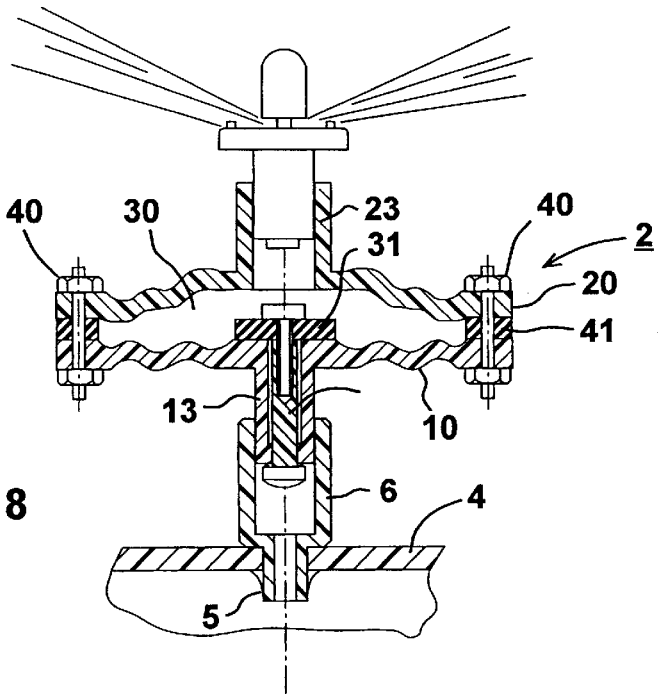
FIG. 8 illustrates the snap-action valve used for supplying water in the form of pulses to a water irrigation device.

The snap-action valve 2 illustrated in the drawings thus also serves as a pulsator for supplying the water to an irrigation device, such as sprinkler 7 in FIG. 8 received within the outlet sleeve 23.

Figure 9:
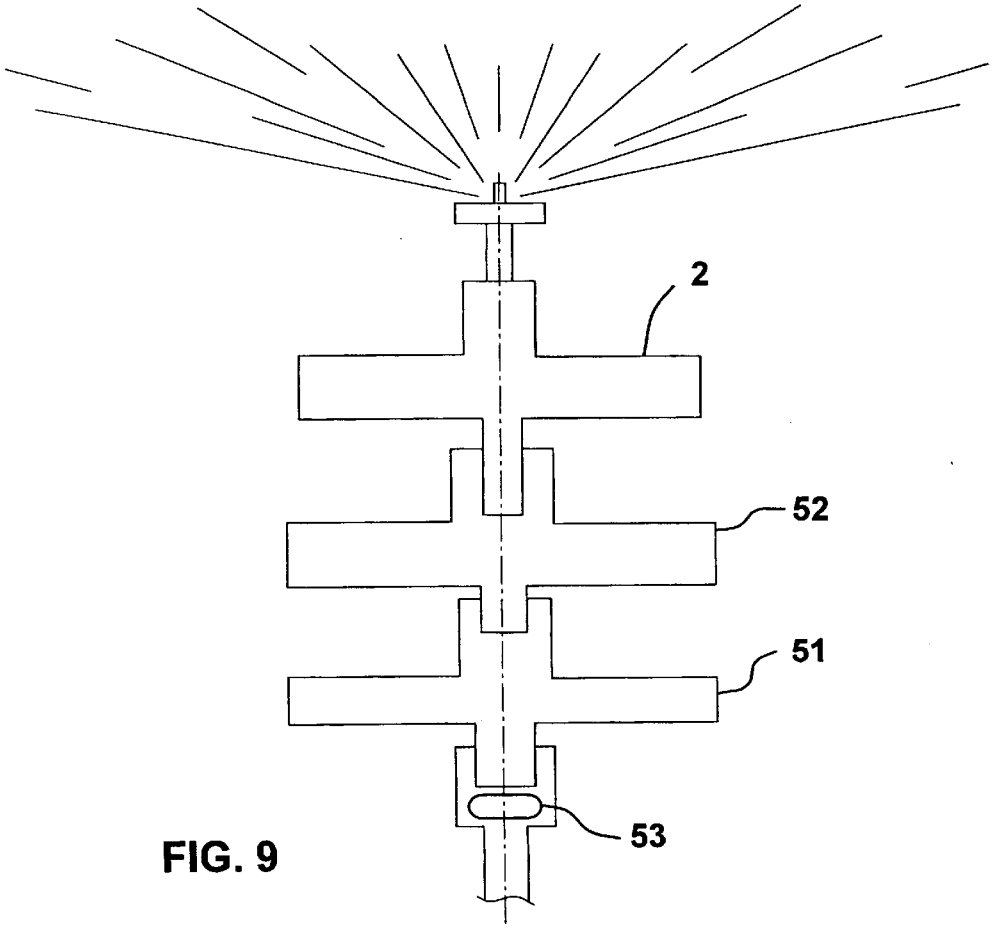
FIG. 9 diagramatically illustrates an assembly including the novel snap-action valve of FIGS. 1–3 together with a plurality of bellows units of the type described in my prior patent application Ser. No. 115969 to provide a higher-rate pulsating water supply to a sprinkler.

FIG. 9 diagramatically illustrates how the snap-action valve 2 may also be used with additional bellows devices, such as described in my above-cited U.S. patent application Ser. No. 08/746,510, to increase the rate of water supply to the irrigation device, if desired. For this purpose, the outer diameter of the inlet connector 13 is substantially equal to the inner diameter of the outlet connector 23, so that the snap-action valve may be assembled in tandem with one or more bellows devices such as described in the above-cited patent application.

Thus, as shown in FIG. 9, the bellows devices, therein designated 51, 52, are attached to the inlet sleeve 13 of the snap-action valve 2 so as to provide a large-capacity, but reduced-rate, flow of the water into chamber 30 of the snap-action valve 2. The flow rate may be preset by a flow-reducer 53 at the inlet end to the one or more bellows devices 51, 52. The snap-action valve 2 will operate as described above with respect to FIGS. 1–3, to maintain the outlet opening firmly-closed, until its plate 20 displaces to the point where it separates from the outer periphery of membrane 31, when this occurs, the valve will open with a snap-action to discharge a quantity of water not only from chamber 30 in the snap-action valve 2, but also from the corresponding chambers in the bellows devices 51, 52.

It will be appreciated that the snap-action valve described herein may be used with other pulsators, and also that it could be used in many other applications requiring a snap-action operation as described above. Therefore, while the invention has been described with respect to one preferred embodiment, it will be appreciated that this is set forth merely for purposes of example, and that many other variations, modifications and applications of the invention may be made.

What is claimed is:

1. A snap-action valve, comprising:

a housing defining a fluid chamber, said housing including a first wall having an inlet opening for conducting a fluid into said chamber, and a second wall having an outlet opening for conducting fluid out of said chamber;

and a deformable membrane mounted within said chamber in alignment with said outlet opening, said deformable membrane having an inner face exposed to the pressure within the chamber, and an outer face exposed to a lower pressure via said outlet opening, such that the differential pressure on the opposite faces of the membrane normally presses the membrane against said second wall to close said outlet opening;

said second wall of the housing being displaceable away from said first wall of the housing to expand said chamber upon an increase in pressure within the chamber such that the differential pressure on the opposite faces of the membrane causes the membrane to deform and to maintain said outlet opening closed until the displacement of said second wall exceeds the deformability of the membrane, whereupon the membrane opens said outlet opening with a snap-action to discharge a quantity of the fluid from the chamber and then recloses with a snap-action upon release of the pressure resulting from such discharge.

2. The valve according to claim 1, wherein said outer face of the deformable membrane is exposed to the atmosphere via said outlet opening.

3. The valve according to claim 1, wherein said deformable membrane is mounted within said chamber by a stem passing through said inlet opening and received within a sleeve fixed to said first wall in alignment with said inlet opening.

4. The valve according to claim 3, wherein the central portion of said membrane is secured to said stem, and the outer periphery of said membrane is deformable by the pressure within the chamber to follow the displacement of said second wall until such displacement exceeds the deformability of the membrane causing the membrane to open said outlet opening with a snap-action.

5. The valve according to claim 3, wherein said sleeve, stem and deformable membrane define a reduced-flow passageway from a source of pressurized fluid into said chamber, which passageway permits a lower rate of fluid flow via said inlet opening into said chamber than that permitted by said outlet opening from said chamber.

6. The valve according to claim 5, wherein said reduced-flow passageway includes:

an axial recess between the outer surface of said stem and the inner surface of said sleeve;

and a radial recess between the inner surface of said first wall of the housing and the inner surface of said deformable membrane.

7. The valve according to claim 6, wherein said reduced-flow passageway includes a plurality of said axial recesses communicating with a plurality of said radial recesses.

8. The valve according to claims 6, wherein said sleeve is received within a socket connectable to said source of pressurized fluid.

9. The valve according to claim 8, wherein said stem is formed with an enlarged head located within said socket, and with spacer projections engageable with said sleeve to provide fluid communication between the interior of said socket and said reduced-flow passageway to said chamber.

10. The valve according to claim 8, wherein said socket includes a flow-reducer for reducing the flow via said inlet opening into said chamber.

11. The valve according to claim 1, wherein said first and second walls of the housing constitute an expansible bellows defining said chamber.

12. The valve according to claim 11, wherein said first and second walls are circular plates joined together at their outer peripheries and formed with annular recesses which permit the central portions of the plates to flex outwardly when the chamber is pressurized, said inlet and outlet openings being formed centrally of their respective circular plates.

13. The valve according to claim 1, wherein said outlet opening is connected to an irrigation device and is effective to supply water thereto in the form of pulses.

14. A snap-action valve, comprising:

an expansible bellows defining a fluid chamber, said bellows including a first wall having an inlet opening for conducting a fluid into said chamber, and a second wall having an outlet opening for conducting fluid out of said chamber;

and a deformable membrane mounted within said chamber in alignment with said outlet opening, said deformable membrane having an inner face exposed to the pressure within the chamber, and an outer face exposed to the atmosphere via said outlet opening, such that the differential pressure on the opposite faces of the membrane normally presses the membrane against said second wall to close said outlet opening;

said second wall of the bellows being displaceable away from said first wall of the bellows to expand said chamber upon an increase in pressure within the chamber such that the differential pressure on the opposite faces of the membrane causes the membrane to deform and to maintain said outlet opening closed until the displacement of said second wall exceeds the deformability of the membrane, whereupon the membrane opens said outlet opening with a snap-action to discharge a quantity of the fluid from the chamber and then recloses with a snap-action upon release of the pressure resulting from such discharge.

15. The valve according to claim 14, wherein said deformable membrane is mounted within said chamber by a stem passing through said inlet opening and received within a sleeve fixed to said first wall in alignment with said inlet opening.

16. The valve according to claim 15, wherein the central portion of said membrane is secured to said stem, and the outer periphery of said membrane is deformable by the pressure within the chamber to follow the displacement of said second wall until such displacement exceeds the deformability of the membrane causing the membrane to open said outlet opening with a snap-action.

17. The valve according to claim 15, wherein said sleeve, stem and deformable membrane define a reduced-flow passageway from a source of pressurized fluid into said chamber, which passageway permits a lower rate of fluid flow via said inlet opening into said chamber than that permitted by said outlet opening from said chamber.

18. The valve according to claim 17, wherein said reduced-flow passageway includes:

an axial recess between the outer surface of said stem and the inner surface of said sleeve;

and a radial recess between the inner surface of said first wall of the housing and the inner surface of said deformable membrane.

19. The valve according to claim 18, wherein said reduced-flow passageway includes a plurality of said axial recesses communicating with a plurality of said radial recesses.

20. The valve according to claim 14, wherein said first and second walls are circular plates joined together at their outer peripheries and formed with annular recesses which permit the central portions of the plates to flex outwardly when the chamber is pressurized, said inlet and outlet openings being formed centrally of their respective circular plates.

* * * * *